US005247991A

United States Patent [19]

Polcer

[11] Patent Number: 5,247,991

[45] Date of Patent: Sep. 28, 1993

[54] HEAT EXCHANGER UNIT FOR HEAT RECOVERY STEAM GENERATOR

[75] Inventor: John Polcer, Brookside, N.J.

[73] Assignee: Foster Wheeler Energy Corporation, Clinton, N.J.

[21] Appl. No.: 891,270

[22] Filed: May 29, 1992

[51] Int. Cl.[5] ..... F28D 7/06; F22D 1/04

[52] U.S. Cl. ..... 165/145; 165/176; 122/7 R; 122/235.15; 122/235.23; 122/476

[58] Field of Search ..... 165/150, 144, 145, 175, 165/176; 122/7 R, 235.15, 235.23, 470, 471–474, 476–478

[56] References Cited

U.S. PATENT DOCUMENTS

| | | | |
|---|---|---|---|
| 1,851,010 | 3/1932 | Jacobus | 122/473 |
| 1,863,174 | 6/1932 | Turner | 122/476 |
| 1,948,939 | 2/1934 | Noack | 122/476 |
| 2,029,284 | 2/1936 | Armacost | 165/145 |
| 2,033,077 | 3/1936 | Kerr et al. | 165/145 |
| 2,138,777 | 11/1938 | Zellhoefer | 165/150 |
| 2,301,433 | 11/1942 | McElgin | 165/176 |
| 2,519,566 | 8/1950 | Hamm | 122/476 |
| 2,699,758 | 1/1955 | Dalin | 122/1 |
| 2,867,416 | 1/1959 | Lieberherr | 165/176 |
| 2,947,522 | 8/1960 | Keller | 165/145 |
| 3,254,631 | 6/1966 | Taylor | 122/7 |
| 3,496,915 | 2/1970 | Grams | 122/478 |
| 3,842,904 | 10/1974 | Gardenier | 122/7 R |
| 4,188,916 | 2/1980 | Csathy et al. | 122/7 R |
| 4,501,233 | 2/1985 | Kusaka | 122/406 S |
| 4,664,067 | 5/1987 | Haneda et al. | 122/7 R |
| 4,685,426 | 8/1987 | Kidaloski et al. | 122/214 |
| 4,693,213 | 9/1987 | Yanai et al. | 122/7 R |
| 4,799,461 | 1/1989 | Shigenaka et al. | 122/7 R |
| 4,829,938 | 5/1989 | Motai et al. | 122/7 R |
| 4,858,562 | 8/1989 | Arakawa et al. | 122/7 R |
| 4,944,252 | 6/1990 | Motai et al. | 122/470 |
| 5,005,529 | 4/1991 | Polcer | 122/7 R |
| 5,065,815 | 11/1991 | David et al. | 165/176 |
| 5,131,459 | 7/1992 | Thompson et al. | 165/145 |

FOREIGN PATENT DOCUMENTS

| | | | |
|---|---|---|---|
| 136418 | 3/1902 | Fed. Rep. of Germany | 122/470 |
| 664012 | 5/1979 | U.S.S.R. | 165/176 |

*Primary Examiner*—John Rivell
*Assistant Examiner*—L. R. Leo
*Attorney, Agent, or Firm*—Marvin A. Naigur

[57] ABSTRACT

A tubular type heat exchanger unit which utilizes upper inlet and outlet headers which are each series connected to at least three lower parallel headers by multiple elongated vertically-oriented tubes. The lower headers are connected together by a plurality of vertically-oriented U-shaped tubes provided in adjacent banks and rows within a thermally-insulated casing. The U-shaped tubes in each tube row are arranged in a staggered pattern relative to the tubes in the adjacent row. Preferably 4–12 lower headers each having a bank of 4–20 vertical tubes are provided. Such heat exchanger unit is enclosed within a thermally-insulated casing and is suitable for use as an economizer and superheater in heat recovery steam generators (HRSG).

11 Claims, 3 Drawing Sheets

HEAT EXCHANGER UNIT FOR HEAT RECOVERY STEAM GENERATOR

BACKGROUND OF INVENTION

This invention pertains to tubular type heat exchangers for use in heat recovery steam generators (HRSG), and particularly pertains to such heat exchangers units utilizing inverted U-shaped tubes connected to elongated parallel headers for economizers and superheaters used in such generators.

Tubular type heat exchangers such as used in economizers or superheaters in heat recovery steam generators usually utilize pairs of upper and lower headers which are connected together by multiple vertically-oriented tubes, so that hot gases such as derived from a gas turbine exhaust can flow transversely across the tubes to heat a fluid flowing vertically in the tubes, so as to generate pressurized steam therein. Such heat exchangers having various tube configurations are known, for example, as disclosed by U.S. Pat. Nos. 4,644,067 to Haneda et al; 4,685,426 to Kidaloski et al; and 4,944,252 to Motai et al. However, such heat exchanger designs utilizing pairs of upper and lower headers are thermodynamically less efficient and are undesirably expensive, so that improved configurations and designs for such heat exchangers have been sought.

SUMMARY OF INVENTION

This invention provides a tubular type heat exchanger unit and assembly having an improved header and tube configuration, and which is particularly useful for economizers and superheaters in heat recovery steam generators (HRSG). The heat exchanger unit utilizes at least three elongated horizontal headers which are oriented adjacent and substantially parallel to each other, and have an inlet and an outlet conduit connected to the first and the last header, respectively. The adjacent headers are connected together by at least three parallel rows of inverted vertically-oriented U-shaped tubes with each row being aligned transverse to the headers, and with the tubes also being aligned in a tube bank connected to each header. The headers are supported from below by suitable structural members. The heat exchanger unit is enclosed by a thermally-insulated casing so as to form an assembly.

In an alternative heat exchanger unit arrangement which is usually preferred, dual upper inlet and outlet headers are also provided which are each flow connected to at least three lower adjacent and substantially parallel headers by means of the multiple vertically-oriented tubes. The adjacent lower headers are connected together by multiple tubes, which are provided in at least three adjacent rows of tubes, with the U-shaped tubes in each row being aligned in a staggered pattern relative to the tubes in the adjacent row. Preferably four to twelve adjacent and substantially parallel lower headers are used, for which the lower adjacent headers are connected together by the multiple inverted U-shaped tubes provided in at least four and usually 6–20 adjacent rows of tubes. The multiple vertically-oriented tubes are also all aligned in a tube bank for each header.

The tubular heat exchanger units and thermally-insulated casing according to this invention advantageously provides a heat exchanger assembly suitable for use as an economizer or superheater in a heat recovery steam generator (HRSG). Such heat exchanger unit and assembly provides uniform heat transfer to a fluid such as water or steam flowing in the vertical tubes and also increases velocity of the fluid flowing therein for improved heat transfer.

BRIEF DESCRIPTION OF DRAWINGS

The invention will be further described by reference to the following drawings, in which.

DESCRIPTION OF INVENTION

Figure 1:
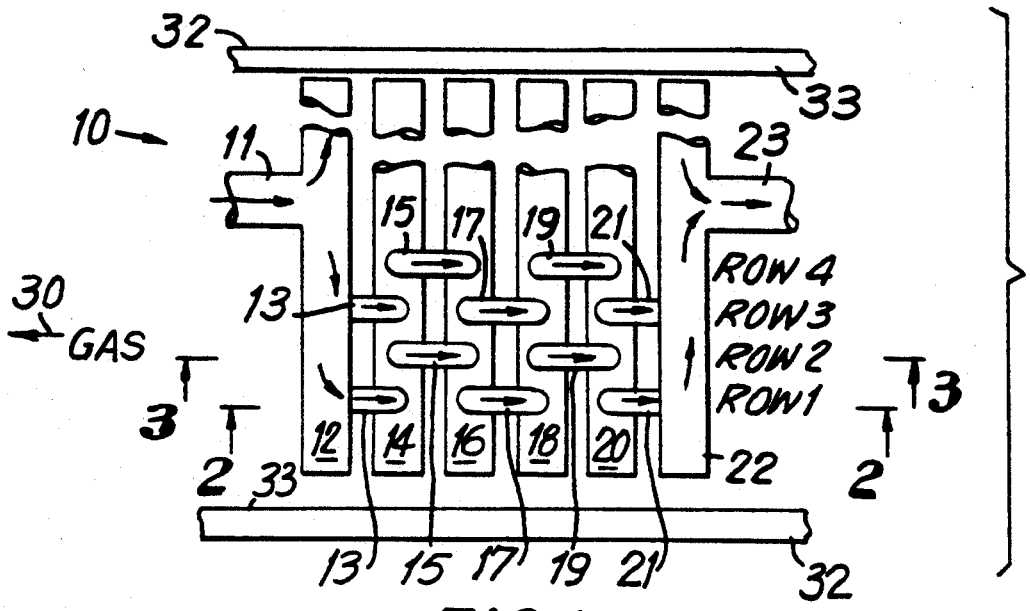
FIG. 1 shows a plan view of one embodiment of a tubular type heat exchanger unit and assembly according to the invention and is suitable for use in a heat recovery steam generator (HRSG)

As is shown by FIG. 1, a heat recovery generator unit 10 includes inlet conduit 11 connected to an inlet upper header 12, which is connected by multiple vertically-oriented tubes 13 to a lower header 14. Lower header 14 is connected by multiple vertically-oriented U-shaped tubes 15 to an adjacent parallel header 16. In the FIG. 1 drawing, four adjacent lower headers 14, 16, 18 and 20 are shown, which headers are connected together by multiple U-shaped vertical tubes 15, 17, 19 and 21, which are aligned in tube banks for each header, as is additionally shown in FIGS. 2 and 3. The last bank of tubes 21 are connected to an outlet upper header 22, which is connected to outlet conduit 23. Thus, it is seen that the four lower headers 14, 16, 18–20 are flow connected together and to the inlet and outlet upper headers by additional rows and parallel banks of vertically-oriented tubes, as further shown in FIGS. 2 and 3. The tube banks connected to each header and the rows of U-shaped tubes which connect together the adjacent lower headers are oriented perpendicular to each other, with the U-shaped tubes in each row 1, row 2, etc. being aligned in a staggered pattern relative to the tubes in the adjacent row of tubes. The inlet conduit 11 and outlet conduit 23 can be located anywhere along the length of the header to which they are each connected, considering space limitations or restrictions for a particular installation. A hot gas stream at 30 such as combustion exhaust gases from a gas turbine can flow transversely across the heat exchanger tube banks and rows, so as to transfer heat to a fluid such as pressurized water or steam flowing inside the multiple tubes.

The headers and tubes for heat exchanger unit 10 are all enclosed within a casing 32, which is internally thermally-insulated at 33 and usually has a rectangular-shaped cross-section. The lower headers 14–20 are supported by structural beams 34 which are spaced apart along the length of the headers, and can be embedded within the thermal insulation 33.

Figure 2:
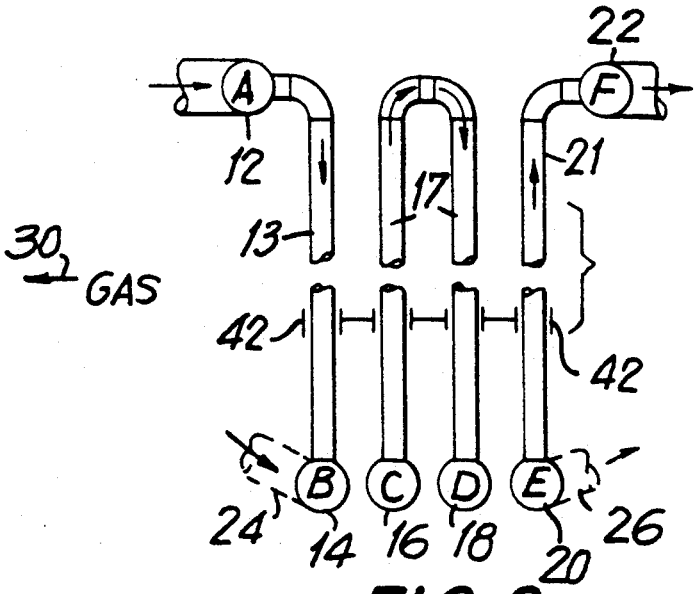
FIG. 2 shows an elevation sectional view taken through one row of vertically-oriented tubes at line 2—2 of FIG. 1, and including both upper and lower headers.
Figure 3:
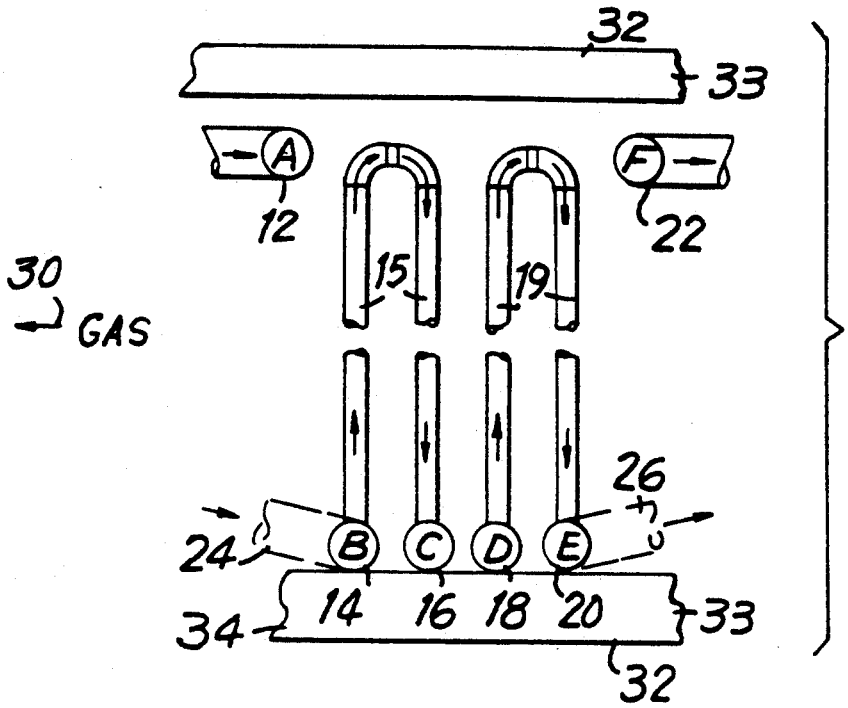
FIG. 3 shows another elevation sectional view taken through an adjacent row of vertically-oriented tubes at line 3—3 of FIG. 1, with the lower headers being structurally supported from below.

In an alternative useful configuration for the heat exchanger units 10 of this invention, the upper inlet and outlet headers 12 and 22 can be omitted and new inlet and outlet conduits 24 and 26 can be connected directly onto the first and last lower headers 14 and 20, respectively, as is generally shown in dotted lines in FIGS. 2 and 3. In this alternative arrangement, the heat exchanger unit is also enclosed within a thermally-insulated casing 32 and the lower headers 14–20 are each supported from beams 34 similarly as described for the FIG. 3 arrangement.

The header and U-shaped tube configuration for the heat exchanger unit of this invention assures uniform heat transfer from the hot flowing gases to the fluid (water or steam) flowing inside the tubes, which increases the fluid velocity inside the tubes, and permits significant reduction of up to 5% in the heat transfer surface area required for a particular heat duty in a heat recovery steam generator (HRSG).

This invention is useful for economizer units heating pressurized water and for superheater units heating steam for heat recovery steam generators (HRSG). The tubes are 1–3 inch outside diameter and 20–60 ft. long. The tubes are each welded pressure-tightly at each end into the upper and/or lower headers, so as to form adjacent tube banks in each header and tube rows connecting the adjacent headers. The headers each have 3–6 inch outside diameter and are 6–14 feet long depending upon the needs of a particular heat recover generator installation. The desired spacing between adjacent lower headers and their connected tubes in the direction of gas flow is 4–10 inches, and the desired spacing between adjacent tubes in the direction parallel to the headers and perpendicular to the gas flow is 4–10 inches. Exhaust gas passing transversely across the tube banks may have superficial velocity of 20–50 ft/sec, temperatures of 200°–1600° F., and fluid pressures in the tubes may be 5–2700 psig.

The number of lower headers and tube banks and rows used for this invention will depend upon the amount of heat to be extracted from the hot exhaust gas. For practical use at least three and not exceeding twelve lower headers and associated tube banks are used, as heat exchange units having twelve headers is usually the maximum shipping size limit. If desired, two or more heat exchange units 10 can be provided in parallel alignment within a single casing, the units being arranged in a tandem flow arrangement for the hot gas stream 30.

Figure 4:
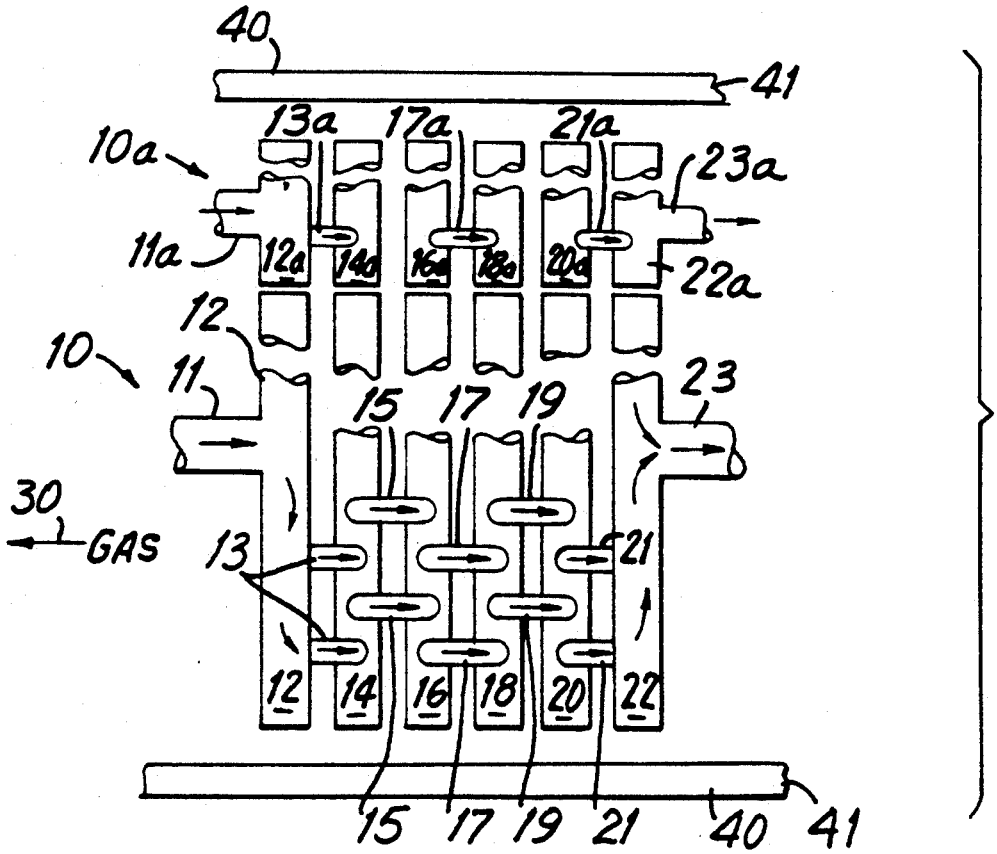
FIG. 4 shows a plan view of a tubular heat exchanger assembly similar to FIG. 1 but including a second heat exchanger unit having its headers located adjacent one end and aligned with a first unit headers, with each unit having separate inlet and outlet conduits.

In another alternative arrangement, two heat exchange units 10 and **10*a* can be provided within a common casing 40, which is internally thermally-insulated at 41, as is shown by FIG. 4. For the second heat exchange unit 10*a*, the headers 14*a* and 20*a* are located adjacent one end and in substantial alignment with the headers 14–20 of the heat first exchange unit 10. Although not shown in FIG. 4, the second heat exchange unit 10*a* is supported similarly as shown in FIG. 3**.

Figure 5:
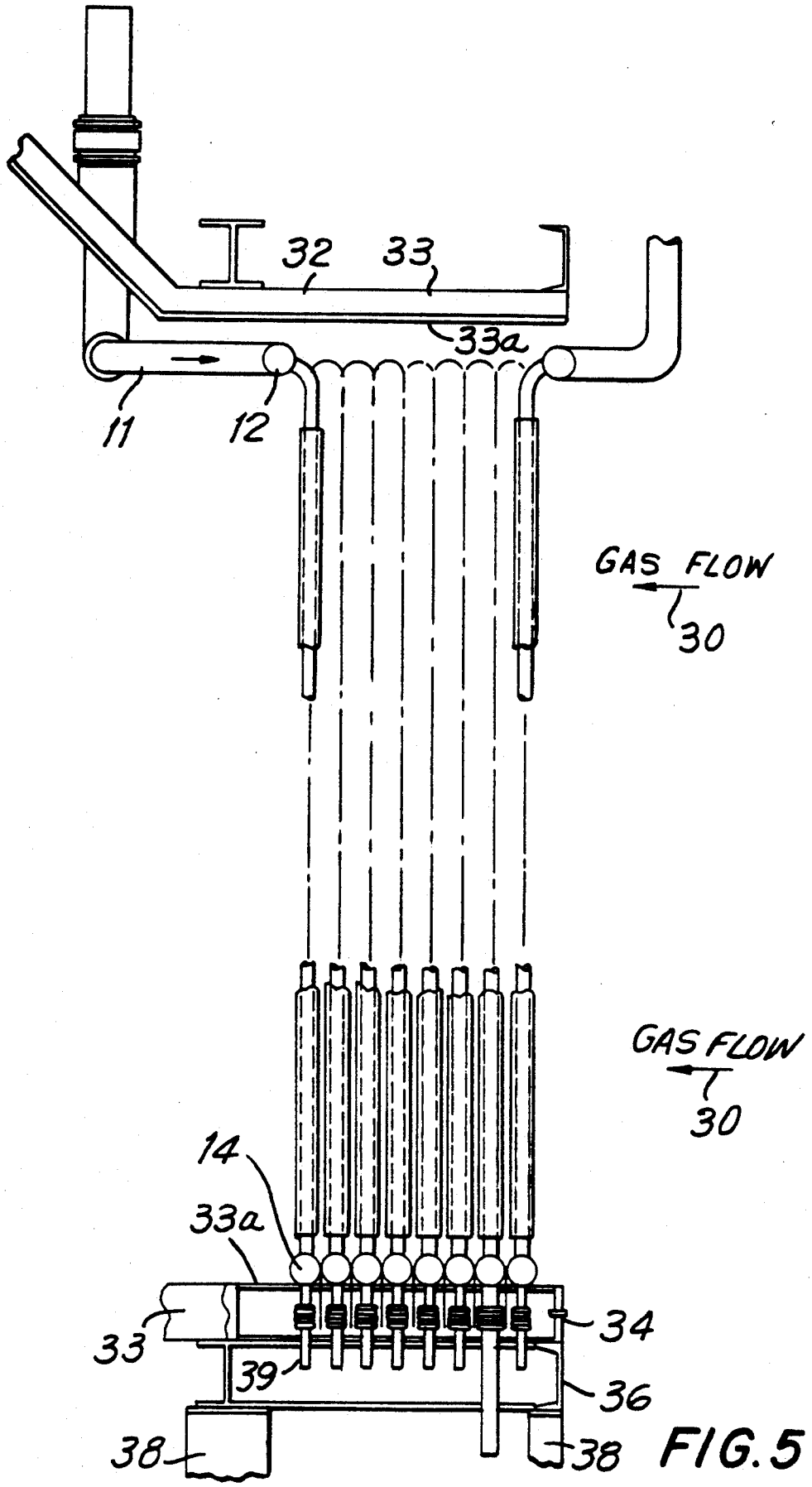
FIG. 5 shows an enlarged detailed elevation view of a tubular type heat exchanger unit similar to FIGS. 2 and 3, and including upper and lower casing and support structures.

The heat exchanger unit 10 is shown in greater detail by FIG. 5, in which the lower headers 14–20 are each structurally supported by horizontal I-beams 34, which beams are each in turn supported by structural beams 36 which are located external to the lower side of casing 32. A suitable thermal insulation material 33 is provided between the lower headers 14–20 and the casing 32 lower side, and is also provided between the upper headers 12, 22 and the casing 32 upper side. The internal thermal insulation 33 can be provided by a rigid refractory material, or preferably can be a ceramic fiber blanket material covered with a thin metal inner liner **33*a* such as stainless steel, so as to reliably retain the fiber insulation in the flowing hot gas stream 30. The casing 32 and steel beam structures 34 and 36 can be supported in any convenient manner, such as being attached to reinforced concrete structures 38. A valved drain connection 39 is usually provided from each lower header 14–20**.

During operations of the heat exchange units 10 in a heat recovery steam generator, a hot combustion gas 30 flows through the elongated thermally-insulated casing 32 and transversely past the tubes at superficial velocity of 30–50 ft/sec, and thereby heats the fluid such as water or steam flowing inside the tubes. For tubes having length exceeding about 10 feet, the tubes are usually stabilized against lateral vibrations by close-fitting anti-vibration support members or ties 42, which extend between adjacent tubes, as shown by FIG. 2, and fit closely around the tubes. For tubes exceeding about 30 feet length, two ties 42 spaced about 8–10 ft. apart along the tube length should preferably be used.

The tubes and headers are usually made of carbon steel or an alloy steel depending upon the operating temperature and pressure required, with the tubes being metal arc welded pressure-tightly into the upper and lower headers of the heat exchanger units.

The invention advantageously provides a tubular heat exchanger unit arrangement for use as either economizer or superheater units in heat recovery steam boilers or generators, in which the multiple tubes are located thermally in parallel so as to achieve good mixing of the gas flow and minimize the heat transfer surface requirements, while also providing good temperature balance and minimum thermal stresses developed in the tubes.

The invention will now be further described by the following typical Example, which should not be construed as limiting in scope.

EXAMPLE

A heat recovery steam generator (HRSG) is constructed according to the invention in which a heat exchanger unit having upper and lower headers connected to banks and rows of vertically-oriented tubes are provided within a rectangular-shaped casing, which is internally thermally insulated. The tubes are metal arc welded pressure-tightly into an inlet and outlet upper header, and into lower headers, as generally shown in FIGS. 2 and 3. Hot combustion gas such as derived from combustion of natural gas, fuel gas, or oil in a gas turbine, with or without auxiliary burners, can pass transversely across the multiple banks and rows of tubes. For an economizer unit, pressurized water can be introduced into the first upper header for the tubes, and water heated in the tubes by the hot gas can be withdrawn from the last upper header. The heated water can be passed to other heat exchange units such as a superheater in which pressurized steam is passed through the headers and tubes and heated by the hot gas. The super heated steam is then expanded in a high pressure turbine for generating power.

Some important typical characteristics and dimensions for the heat exchanger units used as an economizer or superheater are provided in Table 1 below:

| Header and Tube Characteristics | Economizer | Superheater |
|---|---|---|
| Header outside diameter, in. | 4 | 4 |
| Header length, ft. | 10 | 10 |
| Tube outside diameter, in. | 2.0 | 2 |
| Tube length, ft. | 50 | 50 |
| Spacing between adjacent lower headers, in. | 5 | 5 |
| Spacing between adjacent tubes in direction of gas flow, in. | 5 | 5 |
| Spacing between adjacent tubes perpendicular to gas flow direction, in. | 5 | 5 |
| Hot gas inlet temperature, °F. | 600 | 1,100 |
| Combustion gas superficial velocity, ft/sec | 30–40 | 30–40 |
| Pressure in tubes, psig. | 1,500 | 1,500 |
| Fluid inlet temp., °F. | 230 | 1,000 |
| Fluid exit temp., °F. | 575 | 1,200 |

Although this invention has been described broadly and in terms of a preferred embodiment, it will be understood that modifications and variations can be made thereto within the scope of the invention, which is defined by the following claims.

I claim:

1. A tubular type heat exchange unit adapted for transferring heat from a hot flowing gas to a cooler fluid flowing in tubes of the unit, comprising at least three elongated lower headers oriented adjacent and substantially parallel to each other, each said header being connected to the adjacent header by multiple elongated vertically-oriented U-shaped tubes extending upwardly from said headers, said tubes being provided in at least three parallel rows each aligned transverse to the headers with the tubes also being aligned in a tube bank for each header, wherein said tube rows and said tube banks are oriented perpendicular to each other, and said U-shaped tubes in each said row are aligned in a staggered pattern relative to the tubes in the adjacent row of tubes; an inlet upper header and an outlet upper header each provided above and flow connected to a first and last of said lower headers, respectively, by multiple vertically-oriented tubes, and an inlet conduit means connected to the first of said upper headers and an outlet conduit means connected to the last of said upper headers.

2. The heat exchanger unit of claim 1, wherein each said tube has outside diameter of 1–3 inches, each said header has outside diameter of 3–6 inches, and each said tube has length of 20–60 feet.

3. The heat exchanger unit of claim 1, wherein said tubes each have substantially equal outside diameter and substantially equal spacing in each tube bank and row.

4. The heat exchanger unit of claim 1, including a casing which is internally thermally-insulated and adapted to support said adjacent headers and said U-shaped tubes, and to enclose the headers and tubes so as to provide a heat exchanger assembly.

5. The heat exchanger assembly of claim 4, wherein said casing has a rectangular cross-sectional shape.

6. The heat exchanger unit of claim 4, wherein said internal thermal insulation is a blanket of ceramic fiber material covered by an inner thin metal liner.

7. The heat exchange assembly of claim 4, including a second heat exchange unit which is provided in said casing with said first unit, said second heat exchanger unit having at least three lower headers which are adjacent to one end and in alignment with said lower and upper headers of the first heat exchanger unit.

8. A heat recovery generator assembly according to claim 4, wherein at least two heat exchanger units are provided in tandem gas flow arrangement within a rectangular-shaped thermally-insulated casing.

9. The heat exchanger unit of claim 1, wherein a drain connection is provided from each of said elongated lower headers.

10. The heat exchanger unit of claim 1, wherein said tubes have close-fitting support members which fit closely around and extend between adjacent tubes, so as to stabilize the tubes against lateral vibrations.

11. A tubular type heat exchange assembly adapted for transferring heat from a hot flowing gas to a cooler fluid flowing in tubes therein, comprising:

(a) an upper inlet header having an inlet conduit flow connected to said inlet header;

(b) at least three lower elongated headers which are aligned adjacent and substantially parallel with each other, each said lower header being flow connected to the adjacent lower header by multiple elongated vertically-oriented U-shaped tubes, said U-shaped tubes being provided in at least three parallel rows and aligned transverse to the headers, with the tubes also being aligned in a tube bank for each header, wherein said tube rows and said tube banks are oriented perpendicular to each other, and said U-shaped tubes in each said row are aligned in a staggered pattern relative to the tubes in the adjacent row of tubes, with a first said lower header being flow connected to said upper inlet header by multiple vertically-oriented tubes;

(c) an upper outlet header having an outlet conduit flow connected to said outlet header, and also being flow connected to a last said lower header by multiple vertical oriented tubes; and (d) a thermally-insulated casing enclosing said headers and said tubes, so that a hot flowing gas can pass transversely across the tubes and transfer heat to a fluid flowing in the tubes.

* * * * *